US011772110B2

(12) United States Patent
Fippl et al.

(10) Patent No.: US 11,772,110 B2
(45) Date of Patent: Oct. 3, 2023

(54) METHOD FOR REMOVING A FOLLOWER PLATE FROM A CONTAINER

(71) Applicant: Atlas Copco IAS GmbH, Bretten (DE)

(72) Inventors: Thomas Fippl, Westerburg (DE); Patrick Scholl, Weinsberg (DE)

(73) Assignee: Atlas Copco IAS GmbH, Bretten (DE)

( * ) Notice: Subject to any disclaimer, the term of this patent is extended or adjusted under 35 U.S.C. 154(b) by 657 days.

(21) Appl. No.: 16/977,169

(22) PCT Filed: Feb. 6, 2019

(86) PCT No.: PCT/EP2019/052837
§ 371 (c)(1),
(2) Date: Sep. 1, 2020

(87) PCT Pub. No.: WO2019/166200
PCT Pub. Date: Sep. 6, 2019

(65) Prior Publication Data

US 2021/0046493 A1 Feb. 18, 2021

(30) Foreign Application Priority Data

Mar. 2, 2018 (DE) ..... 10 2018 104 763.0

(51) Int. Cl.
*B05B 9/047* (2006.01)
*B05C 11/10* (2006.01)
*B67D 7/64* (2010.01)

(52) U.S. Cl.
CPC ..... *B05B 9/047* (2013.01); *B05C 11/1002* (2013.01); *B67D 7/645* (2013.01)

(58) Field of Classification Search
CPC ... B05B 9/047; B05C 11/1002; B05C 11/101; B05C 11/10; B67D 7/645
See application file for complete search history.

(56) References Cited

U.S. PATENT DOCUMENTS 6,003,732 A * 12/1999 Farley ..... B67D 7/0227 222/405
7,762,428 B2 * 7/2010 Scheugenpflug ..... B67D 7/645 222/53

(Continued)

FOREIGN PATENT DOCUMENTS

DE 44 22 606 C1 8/1995
DE 10 2004 030 654 A1 1/2006

(Continued)

OTHER PUBLICATIONS

International Search Report in PCT/EP2019/052837, dated May 31, 2019.

(Continued)

*Primary Examiner* — Bob Zadeh
(74) *Attorney, Agent, or Firm* — Collard & Roe, P.C.

(57) ABSTRACT

A method removes a follower plate of a device for transporting viscous material out of a barrel-like container. The device has the follower plate for closing the container, which is open at the top and has a container base and a container casing extending upwards from the base, the follower plate being movable toward and away from the base. A force measuring sensor measures a force exerted by a container onto a placement surface; the controller switches the ventilation mode to the lifting mode if the force exerted by the container onto the placement surface exceeds a first target force value; and the controller switches the lifting mode to the ventilation mode if the force exerted by the container onto the placement surface falls below a second target force value, and/or the at least one sensor measures the position of the container relative to a stationary point.

13 Claims, 3 Drawing Sheets

(56) References Cited

U.S. PATENT DOCUMENTS

Figure 1B:
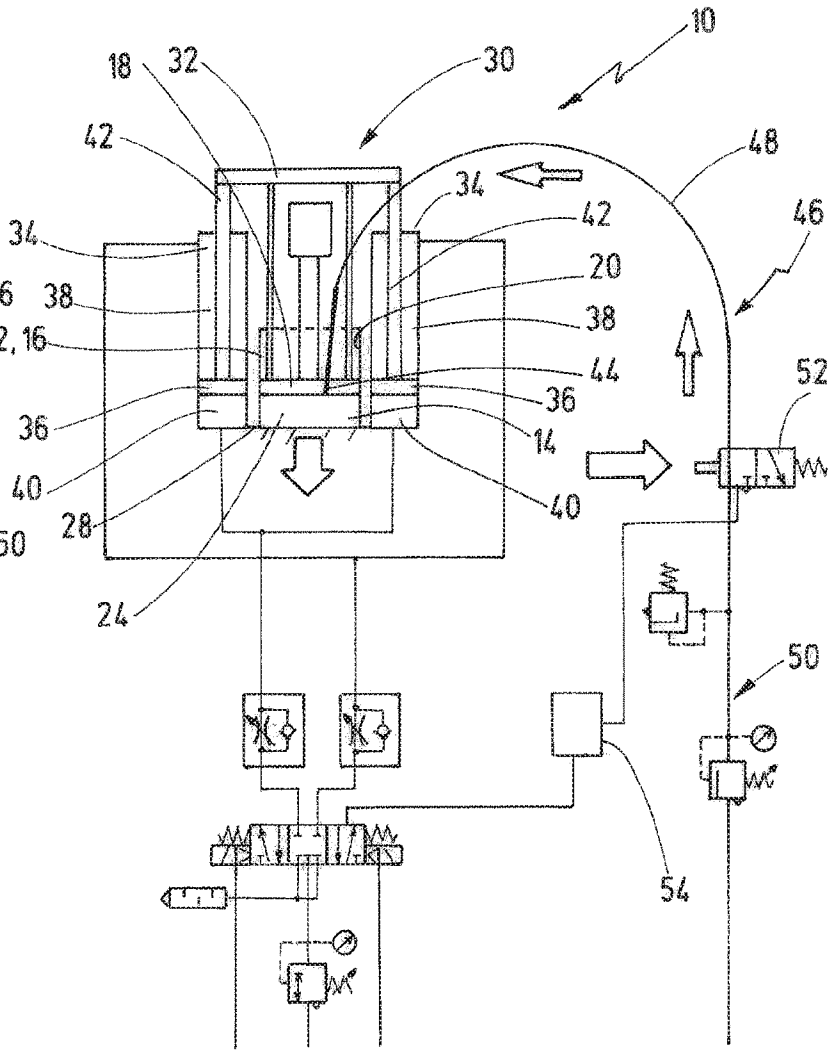

| | | | | |
|---|---|---|---|---|
| 2008/0023082 | A1* | 1/2008 | Schucker | B05C 11/10 137/565.17 |
| 2018/0193871 | A1* | 7/2018 | Scholl | B05B 9/047 |
| 2021/0046493 | A1* | 2/2021 | Fippl | B05C 11/101 |

FOREIGN PATENT DOCUMENTS

| | | | | |
|---|---|---|---|---|
| DE | 10 2005 049 805 | A1 | 2/2007 | |
| DE | 10 2013 020 932 | A1 | 7/2014 | |
| DE | 10 2015 009 130 | A1 | 1/2017 | |
| DE | 102015009130 | A1 * | 1/2017 | B05B 9/047 |

OTHER PUBLICATIONS

German Search Report in DE 10 2018 104 763.0, dated Nov. 12, 2018, with English translation of relevant parts.

English translation of the International Preliminary Report on Patentability in PCT/EP2019/052837, dated Sep. 3, 2020.

* cited by examiner

METHOD FOR REMOVING A FOLLOWER PLATE FROM A CONTAINER

CROSS REFERENCE TO RELATED APPLICATIONS

This application is the National Stage of PCT/EP2019/052837 filed on Feb. 6, 2019, which claims priority under 35 U.S.C. § 119 of German Application No. 10 2018 104 763.0 filed on Mar. 2, 2018, the disclosure of which is incorporated by reference. The international application under PCT article 21(2) was not published in English.

The invention relates to a method for removing a follower plate from a barrel-like container in accordance with the preamble of claim 1, and to an apparatus for conveying viscous material in accordance with the preamble of claim 6.

Methods and apparatuses for removing a follower plate from a container are used, for example, for applying adhesives, sealants, insulation or heat conduction pastes to workpieces, in particular to car body components in the production of motor vehicles. In this regard, the viscous material is conveyed out of the container by means of a pump, by way of the material outlet opening, wherein the follower plate is kept constantly in contact with a surface of the material in the container by means of the lifting device and follows the decreasing material level in the container by being lowered by means of the lifting device. The follower plate is sealed with regard to the container mantle, so that on the one hand, no material can penetrate out of the container, and on the other hand, no air from the surroundings can penetrate into the container. Once the container has been emptied, it is replaced with a new, full container. For this purpose, the follower plate must be moved upward out of the container. In order to be able to move the follower plate upward in the container, the interior of the container must be ventilated, since otherwise a vacuum will occur in the container, which prevents the follower plate from being moved out. When the follower plate is raised, it raises the container with it as the result of the partial vacuum that occurs in the container as well as by means of the adhesion friction of its seals that lie against the inner surface of the container mantle, until compressed air is introduced into the container by means of the ventilation device, by way of the ventilation opening, and the excess pressure that forms in the container presses it downward again. In this regard, it is usual, for the purpose of removing the follower plate from the container, to alternately raise the follower plate a certain distance in a lifting mode of the apparatus, and then to introduce compressed air into the container by means of the ventilation device, in a ventilation mode. Lifting mode and ventilation mode then alternate until the follower plate has arrived at the opening on the top side of the container and can be removed from it. The alternation between the lifting mode and the ventilation mode is manually undertaken by an operator; this is difficult to do and requires some experience on the part of the operator.

A method of the type stated initially is known from DE 10 2015 009 130 A1, in which method a lifting device is used, which has two dual-action cylinders, each having two pressure chambers delimited from one another in sealed manner by means of a piston. Each piston is connected with the follower plate by means of a piston rod, in such a manner that when the follower plate is raised, a first one of the pressure chambers is reduced in size, and the second one of the pressure chambers is increased in size. Furthermore, a pressure sensor is provided, in each instance, which measures the pressure in one of the pressure chambers and uses the pressure values for controlling the lifting device and the ventilation device.

It is therefore the task of the invention to further develop a method and an apparatus of the type stated initially, in such a manner that the follower plate can be more easily removed from the container.

This task is accomplished, according to the invention, by means of a method having the characteristics of claim 1 and an apparatus having the characteristics of claim 6. Advantageous further developments of the invention are the object of the dependent claims.

The invention is based on the idea of not leaving it up to the skill and experience of the operator as to when a switch-over from the lifting mode to the ventilation mode and vice versa is made, but rather always carrying out this switch-over automatically when the same conditions are present. For this purpose, at least one characterizing characteristic variable that characterizes the position of the container and/or of the follower plate is measured, preferably continuously or at short time intervals, by means of at least one sensor, and the measurement values of the characteristic variable are transmitted by the sensor to the controller, which controls the lifting device and the ventilation device. A switch-over between the lifting mode and the ventilation mode then always takes place in one switching direction when the measurement value of the at least one characteristic variable exceeds a predetermined first threshold value, and in the opposite switching direction when the measurement value of the at least one characteristic variable drops below a predetermined second threshold value. The characteristic variable must then be selected in such a manner that it changes in a first direction in the lifting mode, in which the follower plate is raised and ventilation of the container interior is blocked, while is changes in the opposite direction in the ventilation mode, in which raising of the follower plate is stopped and ventilation is released. In this regard, it is possible that the first and/or the second target value is predetermined anew at the start of removal of the follower plate from the container, in other words for every barrel replacement procedure. The target values can be manually established by an operator who recognizes when the container has been raised far enough so that a switch-over to the ventilation mode must take place, or specification of the first and/or of the second target value can be made automatically.

Various characteristic variables are possible as the characteristic variable; these are measured using different sensors. These different embodiments can furthermore be combined with one another.

In general, the lifting device has at least one dual-action cylinder having two pressure chambers that are delimited relative to one another by means of a piston, in pressure-tight manner, wherein the piston is connected with the follower plate by means of a piston rod, in such a manner that when the follower plate is raised, a first one of the pressure chambers is reduced in size and the second one of the pressure chambers is increased in size.

According to one embodiment according to the invention, the at least one sensor is a force measurement sensor, which measures a force exerted by the container on a supporting surface. This force is greatest when the container and the follower plate accommodated in the container rest on the supporting surface with their full weight. As soon as the container is raised off the supporting surface, the weight force that is exerted on the supporting surface and thereby on the force measurement sensor is reduced, going down to zero. The force measurement sensor therefore has the function of a scale. In this regard, the controller switches over from the ventilation mode to the lifting mode when the force exerted on the supporting surface by the container exceeds a first target force value, and the controller switches over from the lifting mode to the ventilation mode when the force exerted on the supporting surface by the container drops below a second target force value.

According to an alternative embodiment, the at least one sensor measures the position of the container with reference to a locally fixed location. In this way, a path by which the container moves, in particular, can be measured absolutely, in particular a path by which the container is raised. It is practical if the at least one sensor measures the height above the supporting surface for the container of a reference point fixed on the container; the controller switches over from the lifting mode to the ventilation mode when the measured height exceeds a first target height, and the controller switches over from the ventilation mode to the lifting mode when the measured height drops below a second target height. The at least one sensor can be a proximity sensor that detects the movement of a switching element moved with the container. It is practical if this element is taken along with a driver fixed in place on the container when the container is raised, and the element itself is thereby raised, rotated and otherwise moved. The driver can be a knurled edge on the container bottom, for example, which runs around circumferentially and projects away radially. However, it is also possible that a driver is releasably attached to the container as an additional component and, in particular, is then removed again before the emptied container is transported away from the conveying apparatus.

It is practical if the at least one switching element can be raised counter to the force of a reset element. The preferably elastic reset element, for example a spring, then constantly forces the switching element back into a rest position. The switching element can be guided by means of a locally fixed guide device, in such a manner that it is moved away from the container during raising. In this manner, it releases the container when the latter is raised too high, for example in the event of a problem during the lifting mode. The at least one switching element can furthermore form a horizontal stop for positioning the container in a conveying position on the supporting surface. In this regard, it serves not only for impacting the sensor so as to detect a movement of the container, but also for precise positioning of the container on the supporting surface under the follower plate. The at least one switching element can furthermore be arranged in such a manner that it is moved a certain distance during a movement of the container into the conveying position, in particular raised or rotated, and thereby indicates, by impacting the sensor, that the container is positioned in the conveying position. Furthermore, it is preferred that the at least one switching element can be raised out of a rest position, in which it covers the at least one sensor completely. The sensor then cannot be influenced by foreign bodies when the switching element is in the rest position.

Figure 1A:
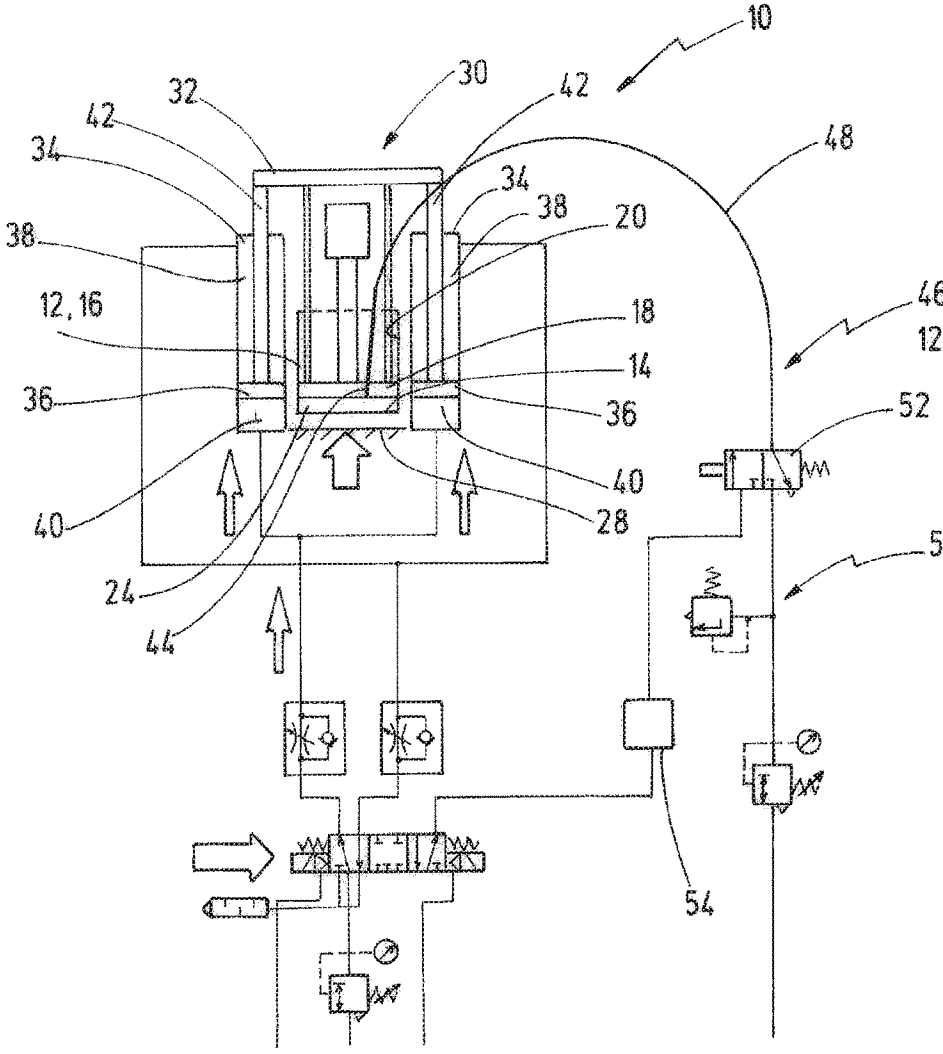
Figure 2:
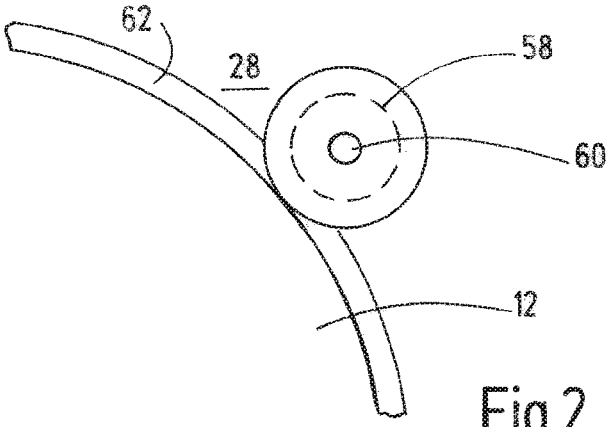
Figure 3:
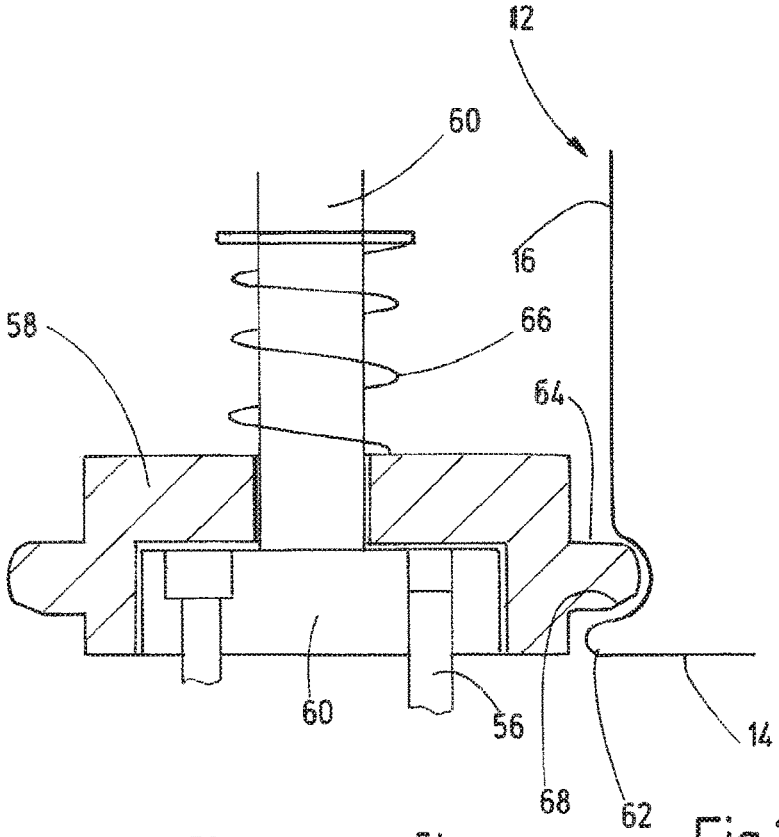
Figure 4:
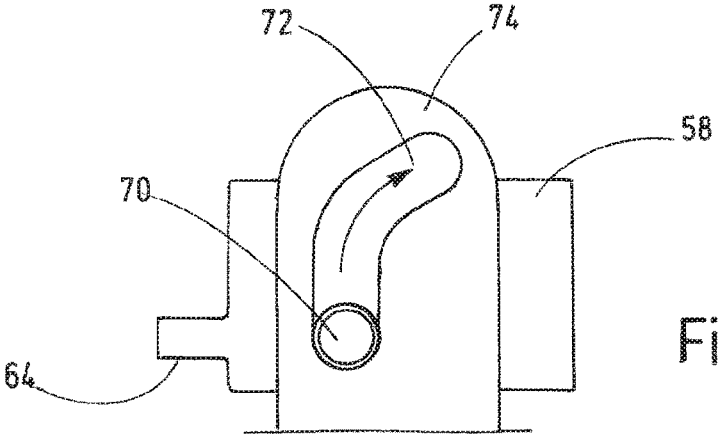
Figure 5A:
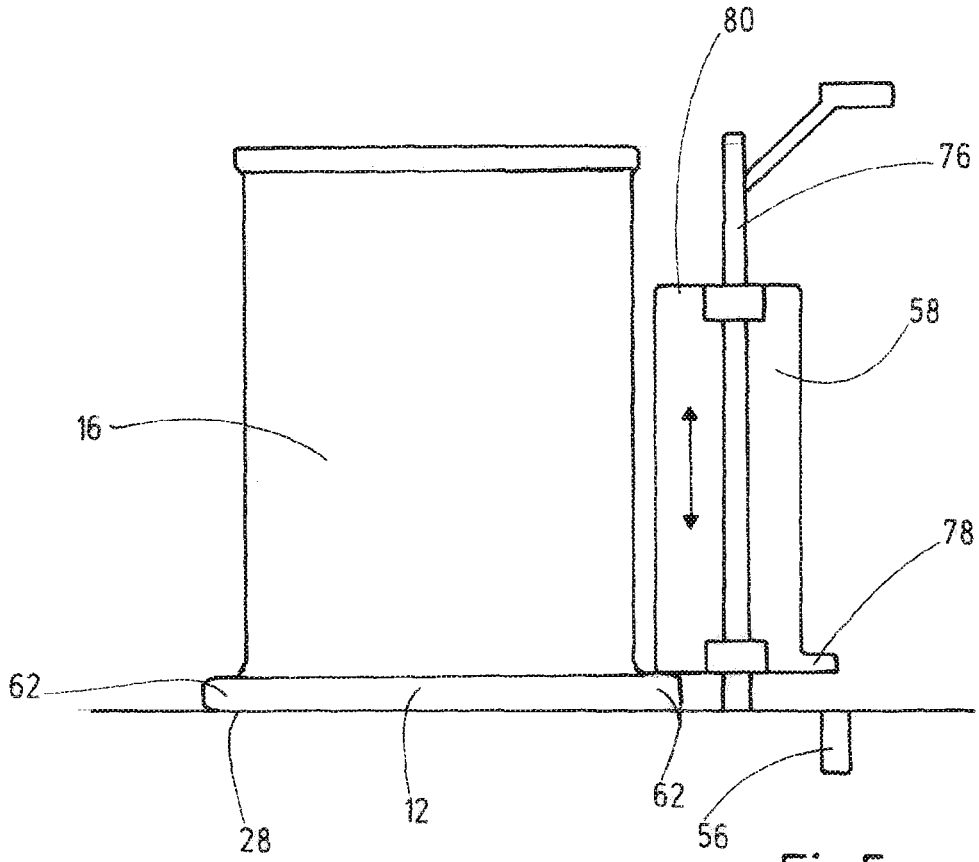
Figure 5B:
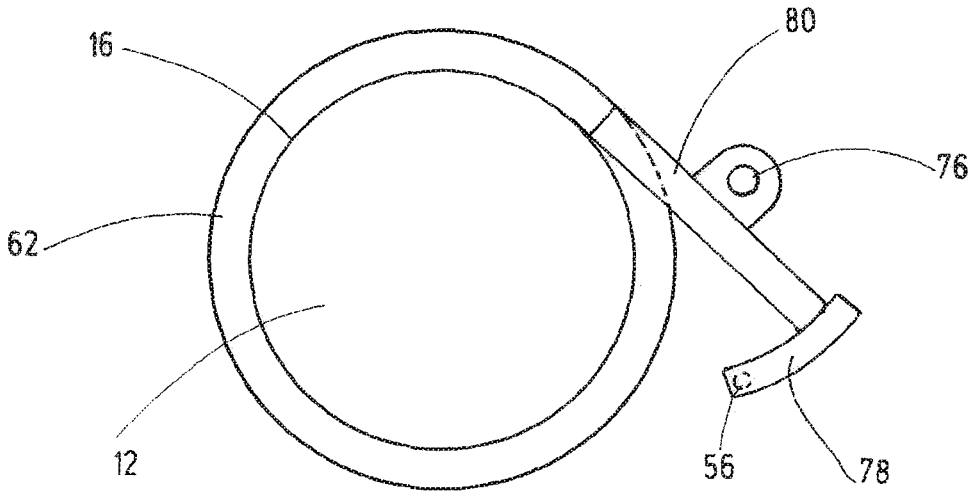

In the following, the invention will be explained in greater detail using the exemplary embodiments shown schematically in the drawing. The figures show:

FIG. 1*a*, 1*b* an apparatus for conveying viscous material, in a schematic representation, in the lifting mode and in the ventilation mode;

FIG. 2 a schematic detail representation with a switching element of the apparatus according to FIG. 1*a*, 1*b*, in a top view;

FIG. 3 a schematic detail representation with a switching element of the apparatus according to FIG. 1*a*, 1*b*, in a side view, partly in section;

FIG. 4 a schematic representation of a switching element in a side view, according to an alternative exemplary embodiment, and FIG. 5*a*, 5*b* a schematic detail representation with a switching element of the apparatus according to FIG. 1*a*, 1*b* according to a further alternative exemplary embodiment, in a top view and in a side view.

In FIG. 1*a*, 1*b*, an apparatus 10 for conveying viscous material out of a cylindrical container 12, which has a container bottom 14 and a container mantle 16 that extends upward from the container bottom 14, is shown schematically. The conveying apparatus 10 has a follower plate 18, which lies on a surface of the viscous material accommodated in the container interior 24, sealed off lying against an inner surface 20 of the container mantle 16. In the representation according to FIG. 1*a*, 1*b*, the container 12 has already been emptied and no longer contains any viscous material. The follower plate 18 has a material outlet opening not shown in any detail, which is connected with a pump that conveys the viscous material, generally an adhesive or sealant, to an application apparatus. During the course of conveying, the amount of the viscous material in the container 12 decreases, so that the follower plate 18 is gradually moved downward so that it continues to make contact with the surface 22 of the viscous material. During conveying, the container 12 stands on a supporting surface 28.

To move the follower plate 18, a lifting device 30 is provided, which has a carrying device 32 rigidly connected with the follower plate 18. Furthermore, it has two dual-action cylinders 34 that are structurally identical, which are arranged on both sides of the follower plate 18, so that their center axes lie on a line with the center axis of the follower plate 18. The cylinders 34 each have a piston 36, which delimits a first, upper pressure chamber 38 and a second, lower pressure chamber 40 relative to one another, in pressure-sealed manner. A piston rod 42 runs through the first pressure chamber 38, in each instance, which rod is passed axially out of the cylinder 34, in sealed manner, wherein two piston rods 42 are rigidly connected with the carrying device 32. The pistons 36 and, with them, the follower plate 18, can be moved upward and downward by means of the introduction of pressure medium such as compressed air or hydraulic fluid into the pressure chambers 38, 40, in particular so as to follow the decreasing material level in the container 12. The first pressure chambers 38 communicate with one another, as do the second pressure chambers 40.

The first active surface of the piston 36, which faces the first pressure chamber 38, in each instance, is smaller than the second active surface, which faces the second pressure chamber 40. At the same pressure in the two pressure chambers 38, 40, a result upward force occurs, which approximately equalizes the weight of the follower plate 18, the lifting device 32, the piston rods 42, and the pistons 36, with a tolerance of less than 10%, preferably of less than 5%.

The follower plate 18 has a ventilation opening 44, by way of which air and, in particular, compressed air can be introduced into the container interior 24. For this purpose, a ventilation device 46 is provided, which has a compressed air line 48 that runs to the ventilation opening 44; a compressed air system 50 is connected with this line, and it can be shut off by means of a compressed air valve 52. When the container 12 has been emptied, the follower plate 18 must be removed from it for a container replacement. Since the plate lies tightly against the inner surface 20, air must be introduced into the container interior by way of the ventilation opening 44, because otherwise, raising the follower plate 18 by means of the lifting device 30 would lead to raising of the container 12, since for one thing, there is significant adhesion friction force between seals that run around the follower plate 18 and the inner surface 20 of the container mantle 16, and for another thing, a partial vacuum occurs in the container interior 24 when the follower plate 18 is pulled out of the container 12. When the follower plate 18 is pulled out of the emptied container 12, so as to replace the container 12 with a new, full container, the process goes step by step, in this regard. First, the follower plate 18 is raised a certain distance, for example by a few centimeters, by means of the lifting device 30, in a lifting mode, as illustrated by the arrows in FIG. 1*a*, wherein the container 12 is raised by the same distance along with the follower plate 18. Subsequently, the lifting process is stopped, and compressed air is introduced into the container interior 24 in a ventilation mode, by means of the ventilation device 46, by way of the compressed air line 48 and the ventilation opening 44, so that the container 12 is moved downward toward the supporting surface 28 again, by means of the excess pressure that occurs in the container interior 24, while the follower plate 18 is held in place, as indicated by the arrow in FIG. 1*b*.

Switching over between the lifting mode and the ventilation mode takes place automatically by means of a controller 54 that controls the lifting device 30 and the ventilation device 46. For this purpose, the apparatus 10 has a sensor 56 that detects the position of the container 12 and transmits its measurement values to the controller 54. In this regard, the sensor 56 measures the position of the container 12 continuously or at short time intervals. In the exemplary embodiment shown (FIG. 2, 3), the sensor 56 is configured as a proximity sensor. It measures the position of the container 12 not directly, but rather indirectly by way of a switching element 58. The sensor is arranged in a sensor holder 60, which is covered by the switching element 58 and surrounded all around on its sides, so that it is impacted exclusively by the switching element 58 and cannot be impacted by foreign bodies in undesired manner. The sensor holder 60 is firmly connected with the supporting surface 28. A knurled edge 62, which runs all around the container bottom 14 and acts as a driver, engages under a radially projecting projection 64 of the switching element 58, so that when the container 12 is raised, the switching element 58 is raised counter to the force of a reset spring 66 supported on the sensor holder 60, and the distance between the switching element 58 and the sensor 56 increases. This increase in the distance, which is identical to the path by which the container 12 is raised, is detected by the sensor 56. If the distance exceeds a predetermined first target value, the sensor 56 emits a signal to the controller 54, which switches over from the lifting mode to the ventilation mode. Thereupon the container 12 drops down again, and with it so does the switching element 58, until the container 12 is once again standing on the supporting surface 28 or is situated just slightly above it, and the distance between the switching element 58 and the sensor 56 drops below a second predetermined target value. The sensor 56 then transmits a signal to the controller 54, which switches over to the lifting mode again.

In the exemplary embodiment shown according to FIG. 2, 3, the switching element 58 furthermore acts as a stop in the positioning of the container 12 on the supporting surface 28, and thereby determines the position, for example also in interaction with the further centering elements, in which the container 12 must be positioned on the supporting surface 28, so as to be situated directly under the raised follower plate 18 in the conveying position. Correct positioning of the container 12 on the supporting surface 28 can then also be detected by the sensor 56. For this purpose, the projection 64 has a leading bevel 68 on its underside, so that the switching element 58 is already raised by a certain distance when the knurled edge 62 is pushed under the projection 64. This raising of the switching element 58 is detected by the sensor 56, so that the latter can send a signal when the knurled edge 62 is situated under the projection 64.

FIG. 4 shows an alternative exemplary embodiment of the switching element 58. This element performs not only a linear upward movement when it is raised, like the switching element 58 according to the first exemplary embodiment. It has a pin 70 that is guided in a guide rail 72 of a locally fixed guide device 74. The guide rail 72 first extends vertically upward and is then angled away at an upward slant away from the container 12, so that when the container 12 is raised, the switching element 58 is first moved linearly upward and then away from the container 12. This measure prevents damage to the switching element if the container 12 is raised too far due to a problem or an error in operation.

In FIG. 5*a*, 5*b*, an alternative exemplary embodiment for the switching element 58 is also shown. This is displaceably mounted on a locally fixed, vertically running guide rod 76, and has a switching part 78 for impacting the sensor 56, once again configured as a proximity sensor, as well as a flap 80 rigidly connected with the switching part 78. The flap 80 extends vertically, for one thing, in other words in the axial direction of the guide rod 76, and radially with reference to the guide rod 76, for another. It is mounted on the guide rod 76 so as to pivot about the guide rod 76 as well as to be linearly displaceable in its longitudinal direction. When a container 12 is moved into its conveying position, the container mantle 16 impacts the flap 80 and pivots it about the guide rod 76 against the reset force of a spring, as shown in FIG. 5*b*. As the result of this pivoting, a switching part 78 is moved over the sensor 56, so that the latter can indicate the presence of the container 12 in the conveying position. Furthermore, the knurled edge 62 is positioned under the flap 80, as shown in FIG. 5*a*. Raising the follower plate 18, taking the container 12 along, then also leads to raising the switching element 58 due to entrainment of the flap 80 by means of the knurled edge 62, so that the switching part 78 is removed from the sensor 56. Raising the switching element 58 by means of the knurled edge 62 can then be measured by the sensor 56. In FIG. 5*a*, 5*b*, a switching element 58 is shown that extends vertically in the form of the flap 80. However, it is also possible that the switching element 58 is a disk that is eccentrically mounted on the guide rod 76 and can be rotated and longitudinally displaced with reference to it.

In summary, the following should be stated: The invention relates to a method for removing a follower plate 18 of an apparatus 10 for conveying viscous material out of a barrel-like container 12, wherein the apparatus 10 has the follower plate 18 for closing off the container 12, which is open toward the top, has a container bottom 14 and a container mantle 16 that extends upward from the container bottom 14, which plate can be moved in the direction toward the container bottom 14 and away from the container bottom 14, lying against the inner surface 20 of the container mantle 16, which faces the container interior 24, and which plate has a material outlet opening and a ventilation opening 44, wherein the apparatus 10 has a lifting device 30 for raising the follower plate 18, a ventilation device 46 for introducing compressed air into the container 12 through the ventilation opening 44, and a controller 54 for controlling the lifting device 30 and the ventilation device 46, and wherein alternately the follower plate 18 is raised in a lifting mode, by means of the lifting device 30, and air is introduced into the container 12 in a ventilation mode, by means of the ventilation device 46. According to the invention, it is provided that at least one characterizing characteristic variable that characterizes the position of the container 12 and/or of the follower plate 18 is measured by means of at least one sensor 56, that the measurement values of the characteristic variable are transmitted by the sensor 56 to the controller 54, and that the controller 54 constantly undertakes alternating automatic switch-over between the lifting mode and the ventilation mode when the measurement value of the at least one characteristic variable exceeds a predetermined first target value and when the measurement value of the at least one characteristic variable drops below a predetermined second target value.

The invention claimed is:

1. A method for removing a follower plate (18) of an apparatus (10) for conveying viscous material out of a barrel-like container (12), wherein the apparatus (10) has the follower plate (18) for closing off the container (12), which is open toward the top, has a container bottom (14) and a container mantle (16) that extends upward from the container bottom (14), which plate can be moved in the direction toward the container bottom (14) and away from the container bottom (14), lying against the inner surface (20) of the container mantle (16), which faces the container interior (24), and which plate has a material outlet opening and a ventilation opening (44), wherein the apparatus (10) has a lifting device (30) for raising the follower plate (18), a ventilation device (46) for introducing compressed air into the container (12) through the ventilation opening (44), and a controller (54) for controlling the lifting device (30) and the ventilation device (46), and wherein alternately the follower plate (18) is raised in a lifting mode, by means of the lifting device (30), and the compressed air is introduced into the container (12) in a ventilation mode, by means of the ventilation device (46), wherein at least one characterizing characteristic variable that characterizes the position of the container (12) and/or of the follower plate (18) is measured by means of at least one sensor (56), wherein the measurement values of the at least one characterizing characteristic variable are transmitted from the sensor (56) to the controller (54), and wherein the controller (54) constantly undertakes alternating automatic switch-over between the lifting mode and the ventilation mode when the measurement value of the at least one characterizing characteristic variable exceeds a predetermined first target value and when the measurement value of the at least one characterizing characteristic variable drops below a predetermined second target value, wherein the at least one sensor (56) is a force measurement sensor, which measures a force exerted by the container (12) on a supporting surface (28), wherein the controller (54) switches over from the ventilation mode to the lifting mode when the force exerted on the supporting surface (28) by the container (12) exceeds a first target force value, and wherein the controller (54) switches over from the lifting mode to the ventilation mode when the force exerted on the supporting surface (28) by the container (12) drops below a second target force value, and/or wherein the at least one sensor (56) measures the position of the container (12) with reference to a locally fixed location.

2. The method according to claim 1, wherein the first and/or the second target value is predetermined at the start of removal of the follower plate (18) from the container (12).

3. The method according to claim 1, wherein the at least one sensor (56) measures a height of a reference point fixed in place on the container, above the supporting surface (28) for the container (12), wherein the controller (54) switches over from the lifting mode to the ventilation mode when the measured height exceeds a first target height and wherein the controller (54) switches over from the ventilation mode to the lifting mode when the measured height drops below a second target height.

4. The method according to claim 3, wherein the at least one sensor (56) is a proximity sensor that detects a movement of a switching element (58) moved with the container (12).

5. The method according to claim 4, wherein the switching element (58) is entrained by a driver (62) fixed in place on the container when the container (12) is raised.

6. An apparatus for conveying viscous material out of a barrel-like container (12) having a container bottom (14) and a container mantle (16) that extends upward from the container bottom (14), having a follower plate (18) for closing off the container (12), which plate can be moved in the direction toward the container bottom (14) and away from the container bottom (14), lying against the inner surface (20) of the container mantle (16), which faces the container interior (24), and which plate has a material outlet opening and a ventilation opening (44), having a ventilation device (46) for introducing compressed air into the container (12) through the ventilation opening (44), having a lifting device (30) for raising the follower plate (18), having a controller (54) for alternately controlling the lifting device (30) in a lifting mode and the ventilation device (46) in a ventilation mode, and having at least one sensor (56) for measuring at least one characteristic variable that characterizes the position of the container (12) and/or of the follower plate (18) and for transmitting the measurement values to the controller (54), wherein the controller (54) is set up for constantly undertaking alternating automatic switch-over between the lifting mode and the ventilation mode when the measurement value of the at least one characteristic variable exceeds a predetermined first target value and when the measurement value of the at least one characteristic variable drops below a predetermined second target value, wherein the at least one sensor (56) is a force measurement sensor, which measures a force exerted by the container (12) on a supporting surface (28) and/or wherein at least one switching element (58) that can move with the container (12) is provided for impacting the at least one sensor (56).

7. The apparatus according to claim 6, wherein the at least one sensor (56) is a proximity sensor for detection of a movement of the at least one switching element (58).

8. The apparatus according to claim 6, wherein a driver (62) for entraining the at least one switching element (58) is firmly connected with the container (12).

9. The apparatus according to claim 6, wherein the at least one switching element (58) can be raised counter to the force of a reset element (66).

10. The apparatus according to claim 6, wherein the at least one switching element (58) is guided by means of a locally fixed guide device (74), in such a manner that the at least one switching element (58) is moved away from the container (12) when raised.

11. The apparatus according to claim 6, wherein the at least one switching element (58) forms a horizontal stop for positioning of the container (12) in a conveying position on the supporting surface (28).

12. The apparatus according to claim 6, wherein the at least one switching element (58) is arranged in such a manner that it is moved a certain distance in the case of a movement of the container into the conveying position.

13. The apparatus according to claim 6, wherein the at least one switching element (58) can be raised out of a rest position in which it completely covers the at least one sensor (56).

* * * * *